US005673860A

United States Patent [19]

Heinemann et al.

[11] Patent Number: 5,673,860

[45] Date of Patent: Oct. 7, 1997

[54] METHOD AND APPARATUS FOR COMMINUTING MOIST MINERAL MATERIAL

[75] Inventors: Otto Heinemann; Michael von Seebach, both of Ennigerloh, Germany

[73] Assignee: Krupp Polysius AG, Beckum, Germany

[21] Appl. No.: 584,276

[22] Filed: Jan. 11, 1996

[30] Foreign Application Priority Data

Feb. 14, 1995 [DE] Germany ..... 195 04 868.7

[51] Int. Cl.[6] ..... B02C 19/00

[52] U.S. Cl. ..... 241/1; 241/21; 241/24.11; 241/29; 241/61; 241/80; 241/152.2; 241/301

[58] Field of Search ..... 241/5, 39, 21, 241/29, 80, 97, 60, 61, 152.2, 1, 24.11, 301

[56] References Cited

U.S. PATENT DOCUMENTS

| | | | |
|---|---|---|---|
| 3,004,721 | 10/1961 | Notzold | 241/60 X |
| 4,355,765 | 10/1982 | Parker | 241/152.2 |
| 4,454,992 | 6/1984 | Draganov | 241/60 X |
| 4,934,613 | 6/1990 | Kukuch | 241/152.2 X |

FOREIGN PATENT DOCUMENTS

| | | | |
|---|---|---|---|
| 665235 | 6/1963 | Canada | 241/60 |
| 3822628 | 1/1990 | Germany . | |
| 4227188 | 4/1993 | Germany . | |

*Primary Examiner*—Mark Rosenbaum
*Attorney, Agent, or Firm*—Learman & McCulloch

[57] ABSTRACT

The invention relates to the comminution of moist mineral material in the comminution zone of a material comminuting machine followed by breaking up of agglomerates which have formed and subsequent wet classification of the broken-up material. A good disagglomerating effect and reliable operation is achieved with relatively compact construction of the apparatus if the comminuted product is subjected to at least an injection of fluid with at least partial disagglomerating effect whilst still within the material bed comminuting machine and immediately after leaving the comminution zone, and afterwards is passed on to the wet classification.

22 Claims, 2 Drawing Sheets

METHOD AND APPARATUS FOR COMMINUTING MOIST MINERAL MATERIAL

The invention relates to a method and apparatus for comminuting moist mineral material.

BACKGROUND OF THE INVENTION

Methods and apparatus of the aforementioned type are known in various forms in the art. They may be used for example for the comminution of moist, and particularly ground-moist or naturally moist raw materials and similar moist materials in the cement, lime and gypsum industry, but also in the preparation/comminution of ore materials.

Thus it is already known in this connection, for example from DE-C-38 222 729, for relatively brittle mineral material to be comminuted in a material bed roll mill, from which the comminuted product, which is obtained at least partially in the form of somewhat round flat agglomerates or scabs, is delivered to a screen classifier. In this case there is disposed between the roll mill and the screen classifier a breaking device which is divided into an inlet section with fluid delivery arrangements for the agglomerates and the fluid and into a turbulence section, at the lower end of which is provided a feed pump for the suspension of fluid and disagglomerated comminuted product. The agglomerate delivery arrangement of the inlet section is constructed like a chute and is disposed below the material bed roll mill, and it opens into a delivery channel to which a fluid delivery arrangement of the forced water injector type is connected and which connects the inlet section to the inlet of the turbulence section.

The object of the invention is to provide a method and apparatus which facilitate a relatively simple and compact construction of the apparatus along with reliable operation and particularly good disagglomerating effect.

SUMMARY OF THE INVENTION

Whereas in the prior art referred to above the comminuted product coming out of the material bed comminuting machine is delivered by way of an agglomerate delivery arrangement to the inlet section of a breaking device and from there is introduced into a turbulence section in order be disagglomerated prior to the classifying operation, the present invention goes a completely different way. In fact, according to the invention the comminuted product coming of the material bed comminuting machine is subjected to an injection of fluid with at least partial disagglomerating effect whilst still within the material bed comminuting machine and immediately after leaving the comminution zone, and afterwards, preferably immediately afterwards, this supplied fluid is passed on together with the comminuted product to the wet classification. This results in an extremely advantageous way in the possibility of constructing or configuring the entire comminuting apparatus for the moist mineral material in an extremely compact way. By the addition or the injection of fluid, preferably water, due to the manner of the injection which is easy to influence the agglomerates or scabs of the comminuted product are broken up or disagglomerated very effectively and, if appropriate, also extremely gently.

Above all in the case of agglomerates which are relatively difficult to break up the comminuted product leaving the comminution zone can be subjected to a mechanical disagglomeration in addition to the fluid injection. This allows a particularly specific disagglomerating effect to be achieved, whilst additionally providing the possibility of influencing this disagglomerating effect by corresponding control of the fluid injection and/or of influencing the disagglomeration of the comminuted product by corresponding construction end control of corresponding mechanical breaking arrangements. In this case it may be particularly advantageous if the fluid is injected with a minimum pressure and optionally also with a specially chosen high pressure preset.

In this method according to the invention it is also particularly advantageous if the fluid is injected into the region disposed immediately downstream of the comminution zone in such a way that walls and machine parts located in this inner region of the material comminuting machine are washed free of material particles of the comminuted product. Thus within the comminuting machine sticking, clogging or incrustation or the like by material particles of the comminuted product are very reliably avoided.

In a further advantageous embodiment it can be ensured that during the wet classification the comminuted product is separated into a fine material fraction to be drawn off (generally in the form of fine material slurry) and into an oversize or coarse material fraction to be fed back to the material bed comminuting machine or the inlet thereof. By such recirculation of material which is not yet sufficiently comminuted a minimum fineness can be guaranteed for the fine material to be drawn off.

The apparatus for comminuting moist mineral material is distinguished according to the invention in that within the material bed comminuting machine and—when viewed in the material flow direction—immediately downstream of the grinding gap a disagglomerating zone is constructed in which is provided a fluid injection arrangement causing at least partial disagglomeration of the comminuted product and which is disposed directly upstream from the wet classifier. Within the comminuting apparatus which is so compactly constructed the comminution of moist, particularly ground-moist or naturally moist mineral material can be carried out particularly reliably in the manner explained above.

THE DRAWINGS

The invention will be explained in greater detail with reference to the drawings, in which:

FIG. 1 shows a vertical sectional view, which has been kept partly schematic, of a first embodiment of the apparatus according to the invention, FIG. 2 shows a schematic vertical sectional view through a second embodiment of the apparatus.

DETAILED DESCRIPTION

In both illustrated embodiments the apparatus serves for the comminution, particularly the material bed comminution of moist mineral material of the type explained in the introduction.

Figure 1:
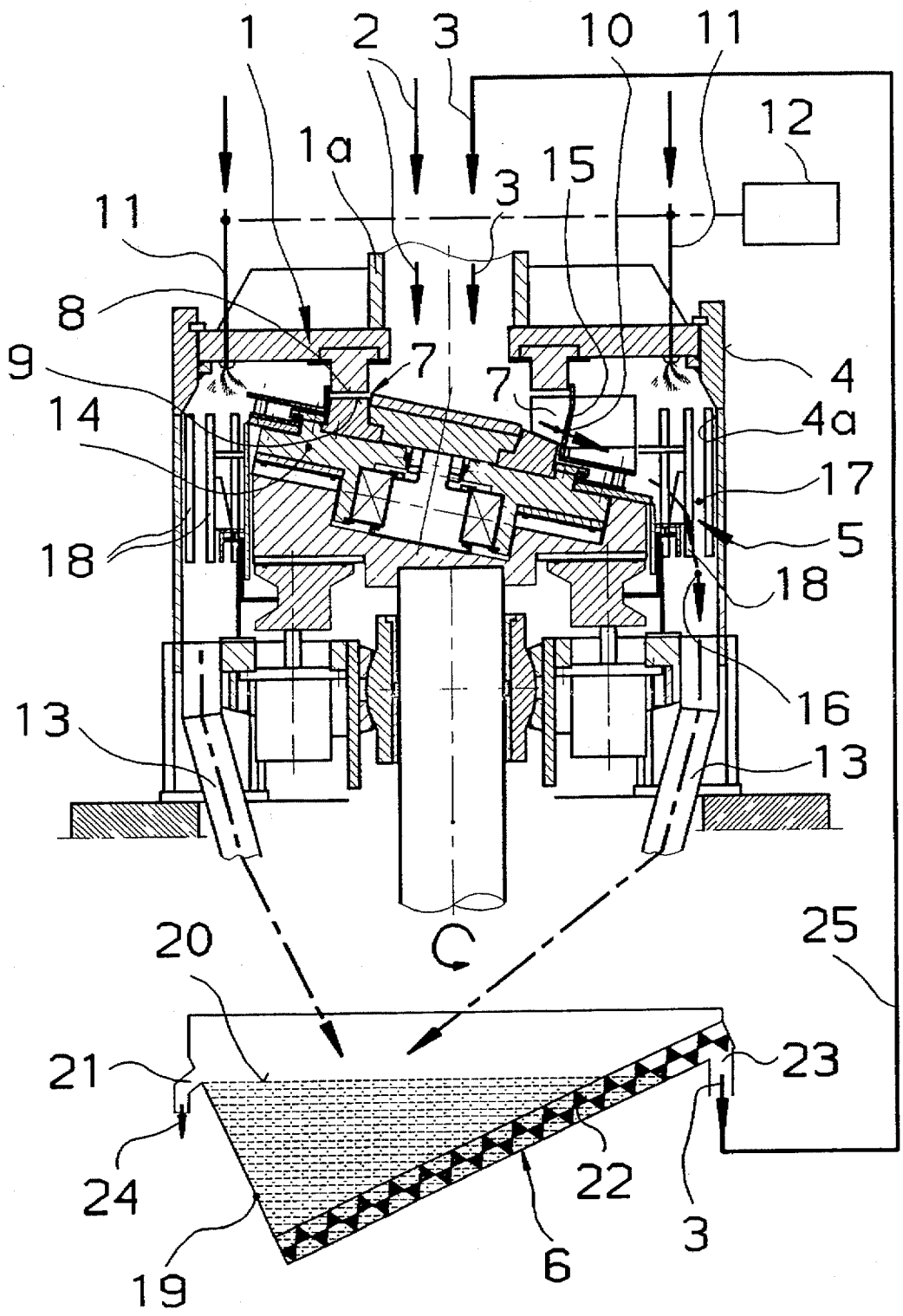

In the first embodiment illustrated in FIG. 1 the apparatus comprises a material bed comminuting machine 1 with a material inlet 1*a* which can preferably be constructed in the form of a feed shaft or the like and to which the material to be comminuted is delivered according to the arrows 2, 3. The material bed comminuting machine 1 has a machine housing 4. Within this machine housing 4 and thus also within the material bed comminuting machine 1 there is provided disagglomerating apparatus 5 for breaking up agglomerates formed during the material bed comminution, and this will be dealt with in detail later. Connected to this disagglomerating apparatus 5 is a wet classifier 6 which is only indicated schematically in FIG. 1 and which in this example is disposed immediately below the material bed comminuting machine 1 and can also, if necessary, form a structural unit with this material bed comminuting machine 1.

The material bed comminuting machine 1 also comprises a comminution zone which—as will be explained in greater detail below—is formed by a grinding gap 7 between two annular grinding surfaces 8, 9 which are pressed against one another with a high pressure. A disagglomeration zone 17 with the aforementioned disagglomerating apparatus 5 is constructed immediately downstream of this grinding gap 7—when viewed in the material flow direction (arrow 10). In this disagglomeration zone 17 there is provided at least one fluid injection arrangement which above all contains a plurality of fluid feed pipes 11 which are distributed in this disagglomeration zone 17 and form a significant part of the disagglomerating apparatus 5. These fluid feed pipes 11 are preferably connected to a control arrangement 12 which is only indicated schematically for setting the fluid pressure desired in each case. The injection pressure for the fluid, which is preferably water, can be chosen so that at least partial disagglomeration of the comminuted product from the material bed comminution can be achieved by this fluid injection arrangement. The comminuted product which is largely or completely disagglomerated or broken up then flows off downwards by way of connecting lines (or pipes) 13 into the wet classifier 6 which is disposed directly downstream of or below the material bed comminuting machine 1.

The material bed comminuting machine 1 according to this first embodiment illustrated in FIG. 1 can basically be constructed according to the design described in DE-A-42 27 188. Accordingly this material bed comminuting machine 1 can in particular have the following features: a stationary first grinding track 8 which is disposed in the machine housing 4 in substantially horizontal alignment and which forms the one grinding surface mentioned above, also a second grinding track 9 which is capable of wobble motion relative to the first grinding track 8 and forms the second grinding surface mentioned above, as well as a driven wobble plate 14 for producing a wobble motion of the second grinding track 9, by which the width of the grinding gap 7 between the two grinding tracks 8, 9 is periodically enlarged and reduced, wherein both grinding tracks are constructed as substantially planar annular tracks and are inclined towards one another at a shallow angle, the wobble plate 14 bears a cover 15 which revolves with it and by which the grinding gap 7 is covered against the exterior in a peripheral part-zone which covers the gap region with the greatest width, and wherein the mill feed material 2, 3 to be comminuted is delivered to the grinding gap 7 from the radially inner periphery and the comminuted mill feed material or comminuted product is discharged outwards (arrows 16) over the outer periphery of the grinding gap 7. Accordingly in this case the disagglomeration zone 17 is formed in an annular space which is located outward of the tracks 8, 9 approximately in the region between the two grinding tracks 8, 9 and the inner peripheral face 4*a* of the machine housing 4 or is delimited by these parts. In this annular space or disagglomeration zone 17 is located the disagglomerating apparatus 5 which has already been mentioned above and which in addition to the fluid injection arrangement with the fluid feed pipes 11 also contains a mechanical disagglomerating device, to which belong the approximately strip-shaped or beater-shaped disagglomerating elements 18 which are provided in the material outlet region of the grinding gap 7 and are at least partially fixed to the wobble plate 14 so as to be fixed against rotation relative thereto. These disagglomerating elements which are disposed movably in the said annular space can co-operate with similar or matching further disagglomerating elements which may for example be held stationary on the inner peripheral face 4*a* of the machine housing. There is no danger of the disagglomerating elements 18 being stuck with material particles or incrusted in some other way or even of a material blockage occurring in this region, since the fluid feed pipes 11, that is to say the fluid injection arrangement, also at the same time ensure that all internal fittings in the region of the disagglomeration zone 17 are washed free.

The wet classifier disposed immediately below the material bed comminuting machine can basically be constructed in any suitable and advantageous manner. In this embodiment illustrated in FIG. 1 the wet classifier 6 is equipped with a fluid tank 19, a fine material outlet 21 disposed in the region of the fluid level 20 in this tank 19, also a conveyor device 22 disposed in the base region of the fluid tank 19 as well as an oversize material outlet 23 provided at one end of this conveyor device 22. The conveyor device 22 can advantageously be constructed as a suitable screw conveyor (as shown in FIG. 1), so that the wet classifier 6 is constructed overall approximately in the form of a screw classifier, the conveyor screw 22 of which is disposed on the base of the fluid tank so that it conveys material obliquely upwards to the oversize material outlet 23. Whereas the fine material to be drawn off through the fine material outlet 21 is discharged according to the arrow 24 as finished material or as material to be further processed in some other way, for the oversize material to be drawn off (arrow 3) at the oversize material outlet 23 a recirculation symbolised only by a schematically indicated line 25 is provided which connects the oversize material outlet 23 to the inlet 1*a* of the material bed comminuting machine 1, so that this oversize material (arrow 3) can be fed back to the comminuting machine 1. The embodiment of the comminuting apparatus illustrated in FIG. 1 and described above makes it readily recognisable that this comminuting apparatus is of extremely compact construction particularly in the region of the material bed comminuting machine 1 and can ensure a particularly good disagglomerating effect with reliable operation.

The material bed comminuting machine can basically also be constructed in a different way, for example according to the principle of a material bed roll mill, as is known infer alia for example from Duda, ZEMENT-DATA-BOOK, Volume 1, 3rd edition, 1985, for instance page 255 to 259. Such an embodiment is illustrated with the aid of FIG. 2.

Figure 2:
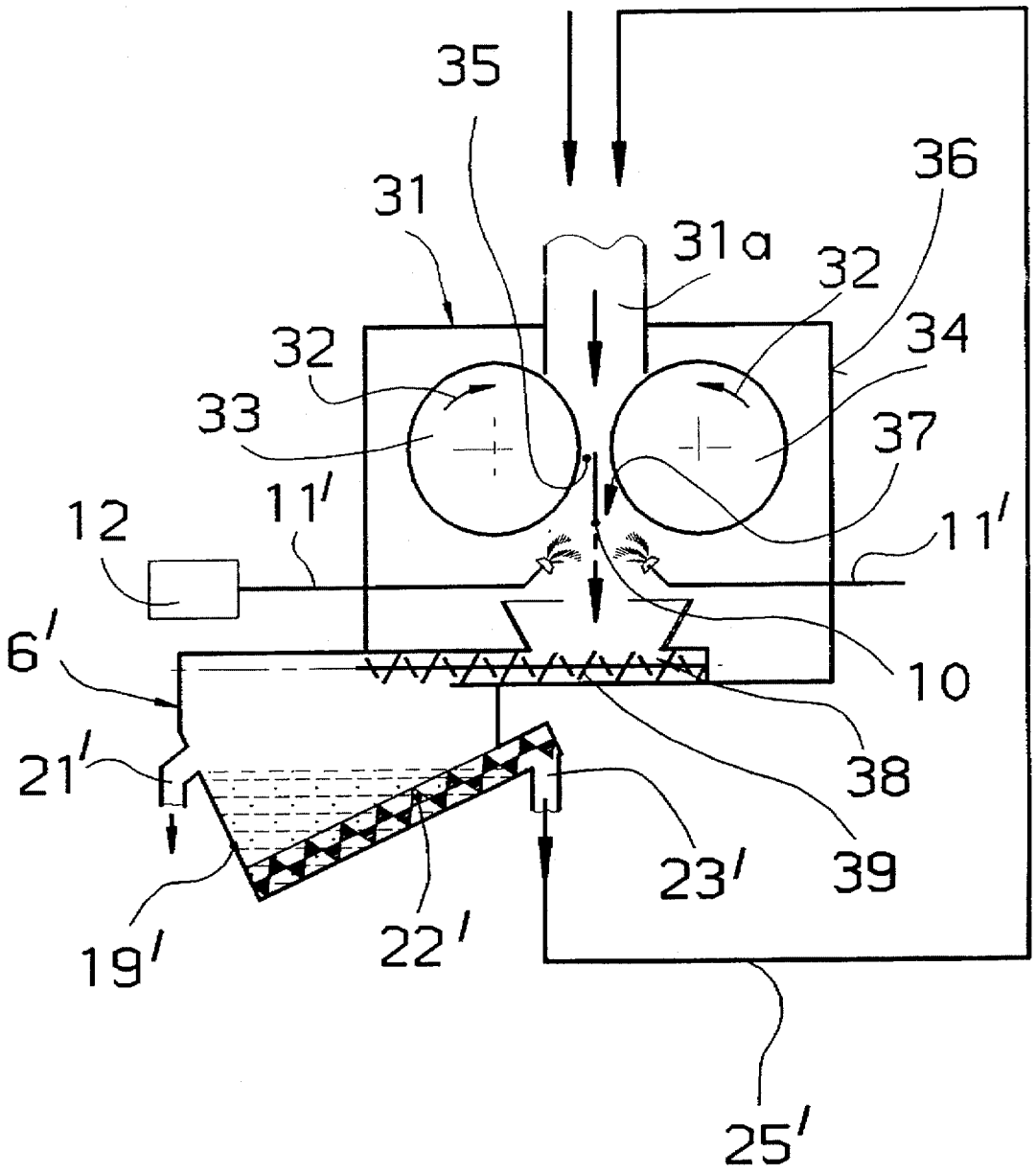

Accordingly the material bed comminuting machine 31 according to FIG. 2 which is constructed in the form of a material bed roll mill contains as essential parts two rolls 33, 34 which are pressed against one another with a high pressure and can be driven so as to rotate in opposite directions (arrows 32), form a grinding gap 35 between them and are disposed in a machine housing 36. In the region immediately below or downstream of the grinding gap 35 there is again constructed the disagglomeration zone 37 in which the agglomerates of the comminuted product which are formed in the material bed comminution should be broken up as far as possible.

Using the same principle as in the first embodiment, in this case too (FIG. 2) a fluid delivery arrangement is provided in this disagglomeration zone 37, that is to say within the material bed comminuting machine 31 and immediately below the grinding gap 35—when viewed in the matarial flow direction (arrow 10). Also here the fluid injection arrangement is again formed above all by a plurality of fluid feed pipes 11 which open into the disagglomeration zone 37 (in substantially the same way as in the example of FIG. 1) for delivery of the pressurised fluid, particularly water.

In addition there is also disposed in this disagglomeration zone 37 a mechanical disagglomerating arrangement 38 which contains at least one breaking device which can be driven in rotation and is preferably made in the form of a beater device or—as as indicated in FIG. 2—by at least one paddle screw 39 which simultaneously has a conveying effect for the broken material out of the machine housing 36 into the wet classifier 6' disposed directly after it. This wet classifier 6' which is constructed in principle in the same way as in the example of FIG. 1 is, in the representation according to FIG. 2, constructed alongside the material bed comminuting machine 31 and forms a structural unit with the latter. In the same way as in the first example (FIG. 1) this wet classifier 6' again contains a fluid tank 19', a fine material outlet 21', an obliquely rising screw conveyer 22' as well as an oversize material outlet 23' which is connected by a recirculating conveyer arrangement 25' to the inlet 31*a* of the material bed comminuting machine 31.

In the studies on which the invention is based it was established that with both embodiments of the comminuting apparatus described above and illustrated in the drawings a very reliable and, if appropriate, extremely gentle disagglomeration of the comminuted product coming out of the material bed comminution can be achieved, wherein a major contributory factor to the latter is a very proportioned addition of fluid which is controllable in pressure, which at the same time can ensure that the material bed comminuting machine is kept clean, particularly in the region of the disagglomeration zone. The fluid consumption can be kept relatively low, since this delivered fluid can be simultaneously used in the subsequent wet classifier. In the material bed comminuting machine 1 according to the example in FIG. 1 it is possible to achieve a material bed comminution which is particulary favourable in energy terms and a particularly good handling of ground-moist mineral materials.

We claim:

1. A method of comminuting moist mineral material comprising delivering said material to a crushing zone; crushing said material in said crushing zone to provide a mixture of crushed and agglomerated particles; discharging said mixture from said crushing zone; applying to said mixture as it is discharged from said crushing zone liquid at sufficient force to effect at least partial disagglomeration of said mixture into relatively coarse and relatively fine fractions of said particles; discharging the relatively coarse and relatively fine fractions to a classifying zone; and separating the relatively coarse and relatively fine fractions in said classifying zone.

2. The method according to claim 1 including delivering said mixture to a disagglomerating zone downstream from said crushing zone.

3. The method according to claim 2 wherein the application of said liquid to said mixture occurs immediately downstream from said crushing zone.

4. The method according to claim 2 wherein the application of said liquid to said mixture occurs immediately downstream from said crushing zone and substantially simultaneously with the movement of said crushed and partially disagglomerated particles into said disagglomerating zone.

5. The method according to claim 2 including applying said liquid to said mixture at such force as to wash particles of said mixture from said disagglomerating zone.

6. The method according to claim 2 including beating said mixture in said disagglomerating zone.

7. The method according to claim 1 including returning the relatively coarse fraction to said crushing zone for further crushing.

8. The method according to claim 1 wherein said classifying zone includes a reservoir and wherein the liquid applied to said mixture is discharged with said fractions to said reservoir.

9. The method according to claim 8 including discharging said liquid and said relatively fine fraction together from said reservoir.

10. The method according to claim 8 including discharging said relatively coarse fraction from said reservoir independently of said liquid and said relatively fine fraction.

11. The method according to claim 8 including maintaining a substantially constant liquid level in said reservoir.

12. The method according to claim 1 wherein said crushing zone and said disagglomerating zone are within a housing and wherein the application of said liquid to said mixture occurs within said housing and under such force as to wash particles of said mixture from said housing.

13. Apparatus for comminuting moist mineral material comprising a housing; crushing means forming a crushing zone in said housing for crushing said material and forming a mixture of crushed and agglomerated particles; liquid injection means in said housing for applying liquid to said mixture under sufficient force as to effect at least partial disagglomeration of said mixture into relatively fine and relatively coarse fractions; classifying means for separating said relatively fine and relatively coarse fractions; and means for delivering said fractions to said classifying means.

14. The apparatus according to claim 13 including a disagglomerating zone within said housing and downstream from said crushing zone; and disagglomerating means in said disagglomerating zone for further disagglomerating said mixture.

15. The apparatus according to claim 14 wherein said disagglomerating means comprises material beating blades and means for driving said blades.

16. The apparatus according to claim 13 wherein said crushing means comprises a pair of confronting rolls defining a grinding gap therebetween, and means for rotating said rolls.

17. The apparatus according to claim 13 wherein said crushing means comprises first and second annular grinding tracks confronting one another and having a gap therebetween, one of said tracks being mounted for rotary wobble motion whereby said gap varies in width in response to rotary wobble motion of said one of said tracks, means for delivering said material to said gap, and means for rotating said one of said tracks.

18. The apparatus according to claim 17 wherein the material is delivered to said gap inward of the outer periphery of said tracks.

19. The apparatus according to claim 17 including an annular space between said grinding tracks and said housing into which said mixture is discharged, said liquid injection means being arranged to discharge said liquid onto said mixture as said mixture enters said annular space.

20. The apparatus according to claim 19 including beater blade means in said annular space for beating said mixture and further disagglomerating said mixture.

21. The apparatus according to claim 20 wherein the liquid discharged from said liquid injection means is in such direction and under such force as to clean particles of said mixture from said blades and said housing.

22. The apparatus according to claim 13 including means for returning the relatively coarse fractions from said classifying means to said crushing zone for further crushing.

* * * * *

UNITED STATES PATENT AND TRADEMARK OFFICE

CERTIFICATE OF CORRECTION

PATENT NO. : 5,673,860

DATED : October 7, 1997

INVENTOR(S) : Otto Heinemann et al

It is certified that error appears in the above-identified patent and that said Letters Patent is hereby corrected as shown below:

Column 4, line 48, change "infer" to -- inter --.

Signed and Sealed this

Fifth Day of May, 1998

*Attest:*

*Attesting Officer*

BRUCE LEHMAN

*Commissioner of Patents and Trademarks*